United States Patent [19]

Aoki et al.

[11] Patent Number: 4,544,097

[45] Date of Patent: Oct. 1, 1985

[54] FUEL INJECTION DEVICE

[75] Inventors: Fujio Aoki; Kazumi Koike, both of Higashi Matsuyama, Japan

[73] Assignee: Diesel Kiki Company, Ltd., Tokyo, Japan

[21] Appl. No.: 554,746

[22] Filed: Nov. 23, 1983

[30] Foreign Application Priority Data

Nov. 29, 1982 [JP] Japan ..... 57-180359[U]

[51] Int. Cl.[4] ..... B05B 9/00

[52] U.S. Cl. ..... 239/126; 239/533.3

[58] Field of Search ..... 239/126, 533.3–533.12

[56] References Cited

U.S. PATENT DOCUMENTS

| | | | |
|---|---|---|---|
| 2,053,312 | 9/1936 | Amery | 239/126 |
| 2,536,542 | 1/1951 | Evans et al. | 239/533.8 |
| 2,558,149 | 6/1951 | Nicolls et al. | 239/126 |
| 2,614,888 | 10/1952 | Nichols | 239/126 |
| 3,258,054 | 6/1966 | Sherman | 239/126 |
| 3,587,977 | 6/1971 | Fussner | 239/126 |
| 3,997,117 | 12/1976 | Köhler et al. | 239/533.8 |

FOREIGN PATENT DOCUMENTS

| | | | |
|---|---|---|---|
| 362815 | 12/1931 | United Kingdom | 239/533.6 |

*Primary Examiner*—Andres Kashnikow
*Assistant Examiner*—Michael J. Forman
*Attorney, Agent, or Firm*—David G. Alexander

[57] ABSTRACT

A fuel injection device for a diesel engine or the like confines the fuel injection pressure to a predetermined range. Fuel is fed under pressure from a fuel supply source to a high pressure chamber to develop a pressure therein. An injection nozzle is mounted on a nozzle holder and has a nozzle hole for injection fuel in response to the pressure in the high pressure chamber. The nozzle holder has thereinside a low pressure chamber which communicates to the outside. An injection rate control valve is mounted in the nozzle holder for delivering fuel to the low pressure chamber on the elevation of the fuel pressure communicated to the high pressure chamber beyond a predetermined value.

3 Claims, 5 Drawing Figures

FUEL INJECTION DEVICE

BACKGROUND OF THE INVENTION

The present invention relates to a fuel injection device for a diesel engine or the like and, more particularly, to an improved fuel injection device which is capable of automatically controlling the injection rate in high speed and low speed engine operation ranges.

The current trend in the art of engines such as diesel engines is to the injection of fuel at higher pressures, that is, to the use of higher injection rates, which cut down smoke and hydrocarbons (HC) emissions in the low speed engine operation range. However, just as it solves the problem concerning the smoke and HC emissions, it creates another problem in the aspect of durability and nitrogen oxides (NOx) emission. Pressurizing the fuel to a substantial level in the low speed operation range would elevate the injection pressure more than necessary in the high speed operation range and require a larger drive torque for an injection pump, detrimenting the pump durability and increasing the NOx concentration in the engine exhaust.

One approach heretofore proposed to keep the fuel pressure in an injection pipe (pipe pressure) below a reference value consists in installing a relief valve in an injection pipe through which the injection pipe may be vented to the outside, as disclosed in Japanese Patent Laid-Open Publication No. 57-129250, for example. Such an approach, however, suffers from the drawback that, due to such a length of the injection pipe which communicates the pump to the nozzle, the volume and fluid resistance in the injection pipe between the relief valve and the nozzle hole are increased and effect the relief valve to lower the control accuracy and thereby render the injection characteristics unstable.

SUMMARY OF THE INVENTION

It is therefore an object of the present invention to provide a new fuel injection device which enhances desirable combustion of fuel by effectively controlling smoke and HC emissions in the low speed operation range of a diesel engine or the like, and NOx concentration in the engine exhaust in the high speed operation range.

It is another object of the present invention to provide a fuel injection device which confines the fuel injection pressure to a predetermined range in low speed and high speed operation ranges of a diesel engine or the like.

It is another object of the present invention to provide a fuel injection device which increase the durability of an injection pump associated with a diesel engine or the like by alleviating the load acting thereon while fuel is injected at a high pressure.

It is another object of the present invention to provide a generally improved fuel injection device.

A fuel injection device for maintaining an injection pressure of fuel supplied from a source of fuel supply within a predetermined range of the present invention comprises a housing having a low pressure chamber communicating to the outside and a high pressure chamber receiving the supplied fuel, an injection valve mounted in the housing for injecting fuel in response to a pressure of the fuel admitted into the high pressure chamber, and injection rate control means disposed in the housing for providing fluid communication between the high pressure chamber and the low pressure chamber when a pressure of the fuel in the high pressure chamber reaches a predetermined value, thereby delivering the fuel into the low pressure chamber.

In accordance with the present invention, a fuel injection device for a diesel engine or the like confines the fuel injection pressure to a predetermined range. Fuel is fed under pressure from a fuel supply source to a high pressure chamber to develop a pressure therein. An injection nozzle is mounted on a nozzle holder and has a nozzle hole for injecting fuel in response to the pressure in the high pressure chamber. The nozzle holder has thereinside a low pressure chamber which communicates to the outside. An injection rate control valve is detachably mounted in the nozzle holder for delivering fuel to the low pressure chamber on the elevation of the fuel pressure communicated to the high pressure chamber beyond a predetermined value.

The above and other objects, features and advantages of the present invention will become apparent from the following detailed description taken with the accompanying drawings.

DESCRIPTION OF THE PREFERRED EMBODIMENT

While the fuel injection device of the present invention is susceptible of numerous physical embodiments, depending upon the environment and requirements of use, a substantial number of the herein shown and described embodiment have been made, tested and used, and all have performed in an eminently satisfactory manner.

Figure 1:
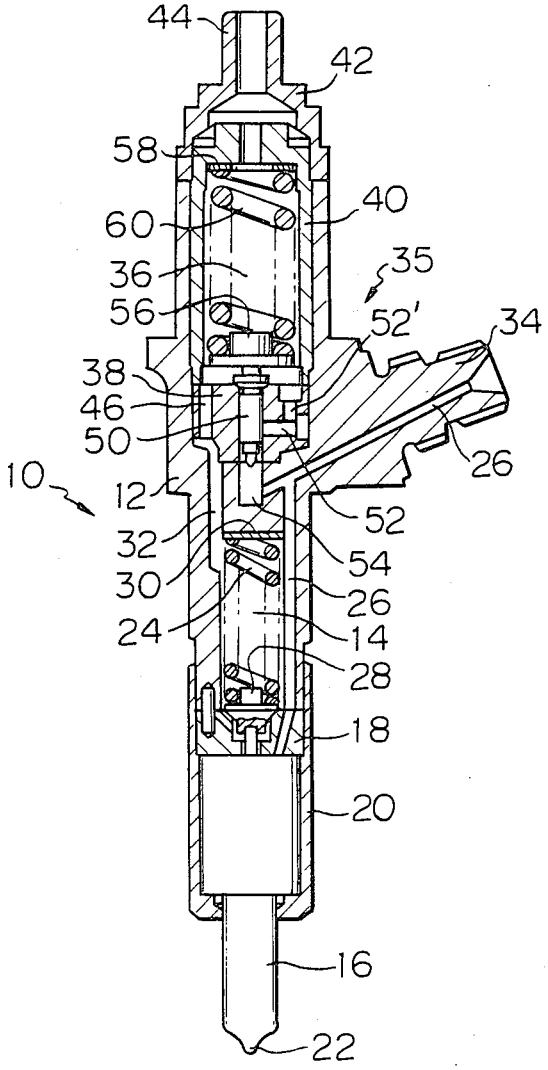
FIG. 1 is a sectional elevation of a fuel injection device embodying the present invention.

Referring to FIG. 1 of the drawings, a fuel injection device embodying the present invention is shown and generally designated by the reference numeral 10. The device 10 includes a nozzle holder 12 which is formed with a cylindrical chamber 14 at a lower end portion thereof. A nozzle 16 has a larger diameter portion which is connected to the lower end of the chamber 14 through a connector 18 by means of a presser nut 20, which is in threaded engagement therewith. In this position of the nozzle 16, the tip of a nozzle hole 22 is located outside the presser nut 20. A spring 24 is preloaded in the chamber 14 to constantly bias a known valve needle (not shown) disposed in the nozzle 16, thereby normally interrupting the communication of the nozzle hole 22 with a passageway 26 inside the nozzle holder 12.

The spring 24 is retained at one end by a spring seat 28 which is engaged with the valve needle, and at the other end by a shim 30 engaging with the inner end portion of the chamber 14. The chamber 14 is communicated to a fuel reservoir (not shown) via a passageway 32 formed in the nozzle holder 12 and a passageway which will be described. The passageway 26 is communicated at one end to a fuel well (not shown) which is defined at a free end portion of the nozzle 16, and at the other end to a delivery port of an injection pump (not shown), more precisely an output port of a delivery valve, by an injection pipe (not shown) which connects to a connector 34. The construction described so far is substantially common to that of the prior art fuel injection device.

In accordance with the present invention, an injection rate control valve mechanism, generally 35, is detachably mounted above the chamber 14 of the nozzle holder 12. The control valve mechanism 35 includes a cylindrical section which defines a low pressure chamber 36 in an upper end portion of the nozzle holder 12. A valve box 38 is coupled in the cylindrical section of the mechanism 35 and fixed to the lower end of the low pressure chamber 36 by means of a sleeve 40, which is threaded into the cylindrical section. A presser nut 42 is engaged with the upper end of the sleeve 40. A connector 44 integral with the pressure nut 42 connects to a return conduit (not shown) to provide fluid communication between the low pressure chamber 36 and the fuel reservoir.

Figure 2:
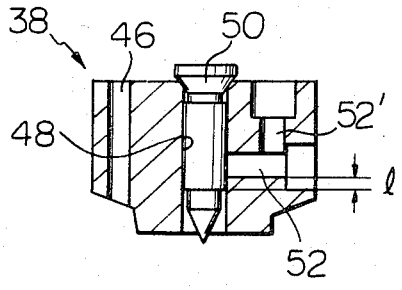
FIG. 2 is an enlarged section of an injection rate control valve included in the device of FIG. 1.

As shown in FIG. 2, the valve box 38 is formed with a passageway 46 for communicating the passageway 32 to the low pressure chamber 36. A cylindrical bore 48 extends throughout the center of the valve box 38, while a valve member 50 is movable up and down in the bore 48. The valve member 50 in movement selectively blocks and unblocks a passageway 52 which opens into the bore 48 of the valve box 38. The nozzle holder 12 is formed with a high pressure chamber 54 below the valve box 38 which is communicated to the bore 48 of the valve box 38 and the passageway 26. A spring seat 56 rests on the top of the valve member 50 in order to support one end of a spring 60 the other end of which is anchored to an annular shim 58, which is positioned at the upper end of the low pressure chamber 38. The spring 60 usually biases the valve member 50 downwardly to block the passageway 52. The passageway 52 is communicated to the low pressure chamber 36 by a passageway 52' which is also formed in the valve box 38.

In operation, fuel is fed under pressure from the reservoir to the nozzle 16 by the injection pump via the passageway 26. Upon the rise of the fuel pressure communicated to the nozzle 16, the valve needle in the nozzle 18 is pressed downwardly against the action of the spring 24 so that the fuel is injected into an engine cylinder via the nozzle hole 22. Simultaneously, the fuel pressure in the passageway 26 is admitted into the high pressure chamber 54 to act on the valve member 50. When the fuel pressure in the passageway 26 has increased beyond a predetermined value, the fluid pressure acting on the valve member 50 from the high pressure chamber side forces the valve member 50 upwardly overcoming the force of the spring 60. This sets up fluid communication of the high pressure chamber 54 with the low pressure chamber 36 via the passageways 52 and 52', thereby venting the passageway 26 to the reservoir.

Figure 4:
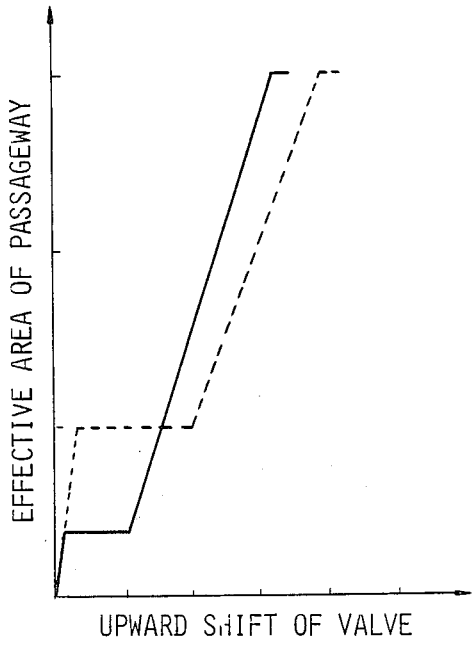
FIG. 4 is a graph showing a relationship between a lift of an injection rate control valve and an area of a nozzle hole.

The range in which the injection rate is to be reduced is dictated by the valve opening pressure, lift area and throttle lift l (see FIG. 2) of the control valve mechanism 35. In detail, the pressure developing in the chamber 26 varies with the lift (shift) of the valve member 50 changing the effective cross-sectional area of the passageway 52 accordingly, as indicated by a solid line in FIG. 4. As soon as the pressure in the passageway 26 rises beyond the predetermined value, a control occurs such that the effective cross-sectional area of the passageway 52 reaches the maximum. Such a passageway area to valve lift characteristic is adjustable as desired merely by replacing the shim 58 which is interposed between the spring 60 and the sleeve 40.

Figure 3:
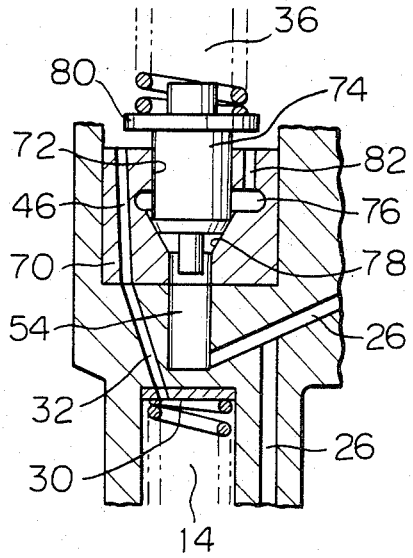
FIG. 3 is a section showing a modification to the injection rate control valve of FIG. 1.

A modification to the control valve mechanism 35 shown in FIGS. 1 and 2 will be described with reference to FIG. 3, in which the same reference numerals as those of FIGS. 1 and 2 designate the same structural elements. In the modified control valve mechanism, a valve box 70 is constructed essentially in the same manner as an injection valve such as one arranged in the nozzle 18. As shown, the valve box 70 has a cylindrical bore 72 for accommodating a valve member 74. The bore 74 is radially enlarged at a lower end portion thereof to define a fuel well 76, while connecting to a conical valve seat 78 below the fuel well 76. The valve member 72 is formed integrally with a valve seat 80 and has at its lower end portion a conical portion engagable with the conical valve seat 78. The fuel well 76 is communicated to the low pressure chamber 36 by a passageway 82. Again, the chamber 14 and the low pressure chamber 36 are intercommunicated by the passageway 46 which extends through the valve box 70.

Figure 5:
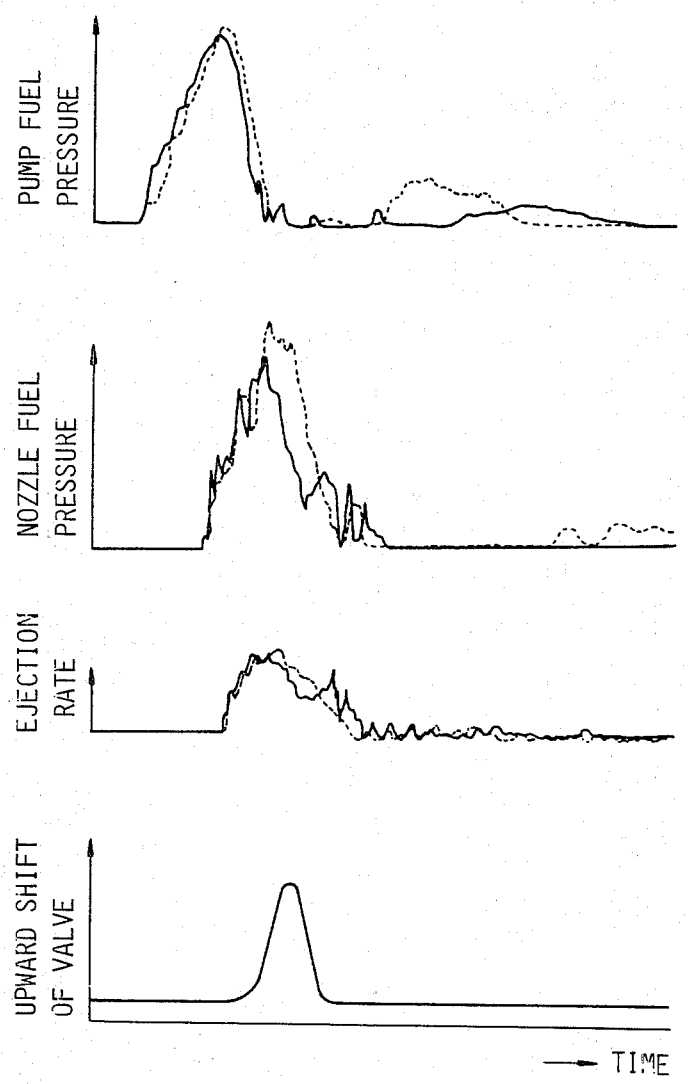
FIG. 5 is a graph representing characteristics of a fuel injection device of the present invention and those of a prior art fuel injection device.

Experiments showed that the embodiment and modification thereof described above with reference to FIGS. 1–3 effectively suppress the injection rate in the low speed engine operation range as indicated by a solid curve in FIG. 5, compared to the prior art device which is represented by a dotted curve.

In summary, it will be seen that the present invention provides a fuel injection device which requires no modification to a conventional injection nozzle construction except for the replacement of a nozzle holder, because an injection rate control valve mechanism thereof is detachably mounted on the nozzle holder of the prior art injection nozzle.

The device of the invention is capable of confining the injection pressure to a range lower than a predetermined value. This prevents the injection pump from being overloaded to thereby enhance the durability of a cam for driving a plunger of the pump, while achieving the exhaust emission control. That is, smoke and HC emissions are reduced by the elevation of injection pressure in the low speed engine operation range, and NOx concentration in the high speed engine operation range.

Another characteristic feature of the present invention is that, due to the lift l at the end of which the valve member 50 vents the passageway 26, the spring 60 and the fuel in the low pressure chamber 36 offer a damping effect allowing the device to cut the fuel pressure substantially flat.

Additionally, compared to the prior art device which is constructed to relieve fuel pressure from an injection pump (e.g. a plunger chamber of a distributor type injection pump), the device of the invention controls the pipe pressure in a position adjacent to the nozzle hole and, thereby, proportionally cuts down the influence of pressure pulsation in the injection pipe or the like. This increases the control accuracy and sets up stable injection characteristics.

Various modifications will become possible for those skilled in the art after receiving the teachings of the present disclosure without departing from the scope thereof.

What is claimed is:

1. A fuel injection device for maintaining an injection pressure of fuel supplied from a source of fuel supply within a predetermined range, comprising:

a housing having a low pressure chamber communicating to the outside and a high pressure chamber receiving the supplied fuel;

an injection valve mounted in said housing for injecting fuel in response to a pressure of the fuel admitted into the high pressure chamber; and injection rate control means disposed in the housing for providing fluid communication between the high pressure chamber and the low pressure chamber when a pressure of the fuel in the high pressure chamber reaches a first predetermined value, thereby delivering the fuel into the low pressure chamber, the injection rate control means comprising control valve means for controlling the communication between the high pressure chamber and the low pressure chamber in response to a pressure of the fuel in the high pressure chamber;

the control valve means comprising a valve box formed with a cylindrical through bore communicating to the high pressure chamber and passageway means for communicating said bore to the low pressure chamber, a valve member slidably received in said bore for controlling the communication between the bore and the passageway means in response to a pressure of the fuel, and biasing means for biasing said valve member in a direction for blocking communication between the bore and the passageway means, the biasing means comprising a spring one end portion of which is engaged with one end portion of the valve member;

the spring having a spring constant which is selected to press one end portion of the valve member to provide communication between the bore and the passageway means when the fuel pressure in the high pressure chamber reaches the first predetermined value;

the valve member and spring being constructed to progressively increase communication between the bore and the passageway means as the pressure rises from the first predetermined value to a second predetermined value and provide full communication between the bore and the passageway means at pressures above the second predetermined value.

2. A fuel injection device as claimed in claim 1, in which the bore is formed iwth a conical valve seat in a portion therof adjacent to the high pressure chamber, the valve member being with a conical portion engagable with said valve seat biased by biasing means.

3. A fuel injection device for maintaining an injection pressure of fuel supplied from a source of fuel supply within a predetermined range, comprising:

a housing having a low pressure chamber communicating to the outside and a high pressure chamber receiving the supplied fuel;

an injection valve mounted in said housing for injecting fuel in response to a pressure of the fuel admitted into the high pressure chamber; and injection rate control means disposed in the housing for providing fluid communication between the high pressure chamber and the low pressure chamber when a pressure of the fuel in the high pressure chamber reaches a predetermined value, thereby delivering the fuel into the low pressure chamber, the injection rate control means comprising control valve means for controlling the communication between the high pressure chamber and the low pressure chamber in response to a pressure of the fuel in the high pressure chamber;

the control valve means comprising a valve box formed with a cylindrical through bore communicating to the high pressure chamber and passageway means for communicating said bore to the low pressure chamber, a valve member slidably received in said bore for controlling the communication between the bore and the passageway means in response to a pressure of the fuel, and biasing means for biasing said valve member in a direction for blocking communication between the bore and the passageway means, the biasing means comprising a spring one end portion of which is engaged with one end portion of the valve member;

the spring having a spring constant which is selected to press one end portion of the valve member to provide communication between the bore and the passageway means when the fuel pressure in the high pressure chamber reaches the predetermined value;

the valve member being progressively moved through a predetermined range from a first seated position to a second position at fuel pressures increasing from zero to the predetermined value respectively, the valve member blocking communication between the bore and the passageway when positioned within said range.

* * * * *